US006691593B2

(12) United States Patent
Hu

(10) Patent No.: US 6,691,593 B2
(45) Date of Patent: Feb. 17, 2004

(54) RETAINER RING FOR SECURELY RETAINING A FIRST OBJECT TO A SECOND OBJECT

(76) Inventor: Bobby Hu, 8F, No. 536~1, Ta Chin Street, Taichung (TW)

( * ) Notice: Subject to any disclaimer, the term of this patent is extended or adjusted under 35 U.S.C. 154(b) by 0 days.

(21) Appl. No.: 10/094,342

(22) Filed: Mar. 8, 2002

(65) Prior Publication Data

US 2003/0097911 A1 May 29, 2003

(30) Foreign Application Priority Data

Nov. 28, 2001 (TW) ..... 90220753 U

(51) Int. Cl.[7] ..... B25B 13/46

(52) U.S. Cl. ..... 81/60; 24/673; 24/675; 24/676; 403/DIG. 7

(58) Field of Search ..... 81/60–63.2; 24/546–547, 24/555–558, 561, 564, 566, 673–678; 403/DIG. 7; 299/107, 109

(56) References Cited

U.S. PATENT DOCUMENTS 4,324,158 A * 4/1982 Le Roy ..... 81/60
4,480,511 A * 11/1984 Nickipuck ..... 81/124.6
5,067,775 A * 11/1991 D'Angelo ..... 299/104
5,918,512 A * 7/1999 Habermehl et al. ..... 81/438
5,975,186 A * 11/1999 Day ..... 160/321
6,305,255 B1 * 10/2001 Wu ..... 81/439

* cited by examiner

*Primary Examiner*—D. S. Meislin
(74) *Attorney, Agent, or Firm*—Alan Kamrath; Rider Bennett, LLP

(57) ABSTRACT

A retainer ring includes at least two holding sections and at least one engaging section. Each holding section has a radius of curvature equal to half of a diameter of a reduced section of a first object, e.g., an adaptor. The engaging section has a radius of curvature greater than that of the holding sections. The holding sections securely clamp the reduced section of the first object with the engaging section partially protruding out of the reduced section of the first object for engaging with a second object e.g., a box end of a wrench.

20 Claims, 15 Drawing Sheets

RETAINER RING FOR SECURELY RETAINING A FIRST OBJECT TO A SECOND OBJECT

BACKGROUND OF THE INVENTION

1. Field of the Invention

The present invention relates to a retainer ring for securely retaining a first object, e.g., an adaptor or a bit, to a second object, e.g., a box end of a wrench or a shank of a screwdriver.

2. Description of the Related Art

FIG. 12A of the drawings illustrates a conventional retainer ring 1 engaged in an annular groove 3 of an object 2, e.g., an adaptor. After mounting on the object 2, the retainer ring 1 could move to a position shown in FIG. 12B under the action of gravity. This is because there is no means for securely retaining retainer ring 1 in the annular groove 3. As a result, as illustrated in FIG. 13, it would be impossible to mount the object 2 into a receiving compartment 4 of, e.g., a box end of a wrench, as the retainer ring 1 protrudes too much outward to be inserted into the receiving compartment 4.

SUMMARY OF THE INVENTION

An object of the present invention is to provide a retainer ring for securely retaining a first object to a second object.

In an embodiment of the invention, the first object is an adaptor and the second object is a box end of a wrench. In another embodiment of the invention, the first object is a bit and the second object is a shank of a screwdriver.

A retainer ring in accordance with the present invention comprises at least two holding sections and at least one engaging section. Each holding section has a radius of curvature equal to a diameter of a reduced section of a first object. The engaging section has a radius of curvature greater than that of the holding sections. The holding sections securely clamp the reduced section of the first object with the engaging section partially protruding out of the reduced section of the first object for engaging with a second object.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
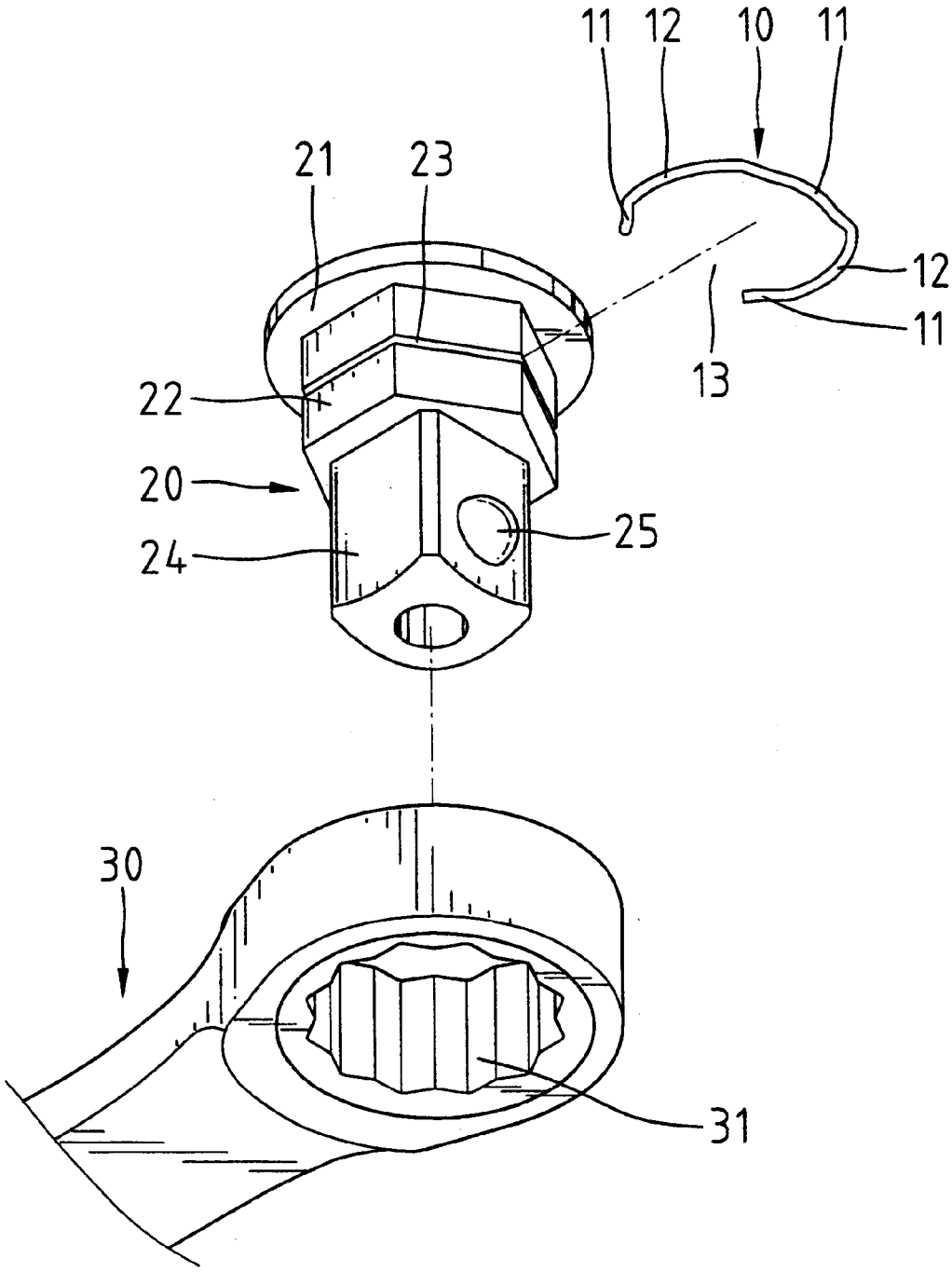
FIG. 1 is an exploded perspective view of a wrench, an adaptor, and a retainer ring in accordance with the present invention.

Referring to FIG. 1, in accordance with the present invention, a retainer ring 10 is provided to securely retain a first object, e.g., an adaptor 20 to a second object, e.g., a box end of a wrench 30. The adaptor 20 includes a first end 21 engaged in a receiving compartment 31 of the box end of a wrench 30 and a second end 24 that acts as a drive end for engaging with and driving a socket (not shown). A spring-biased ball 25 is mounted to the drive end 24 of the adaptor 20 for releasably engaging with the socket, which is conventional and therefore not described in detail. The first end 21 of the adaptor 20 includes a hexagonal engaging portion 22 with a reduced section in which an annular groove 23 is defined.

Figure 1A:
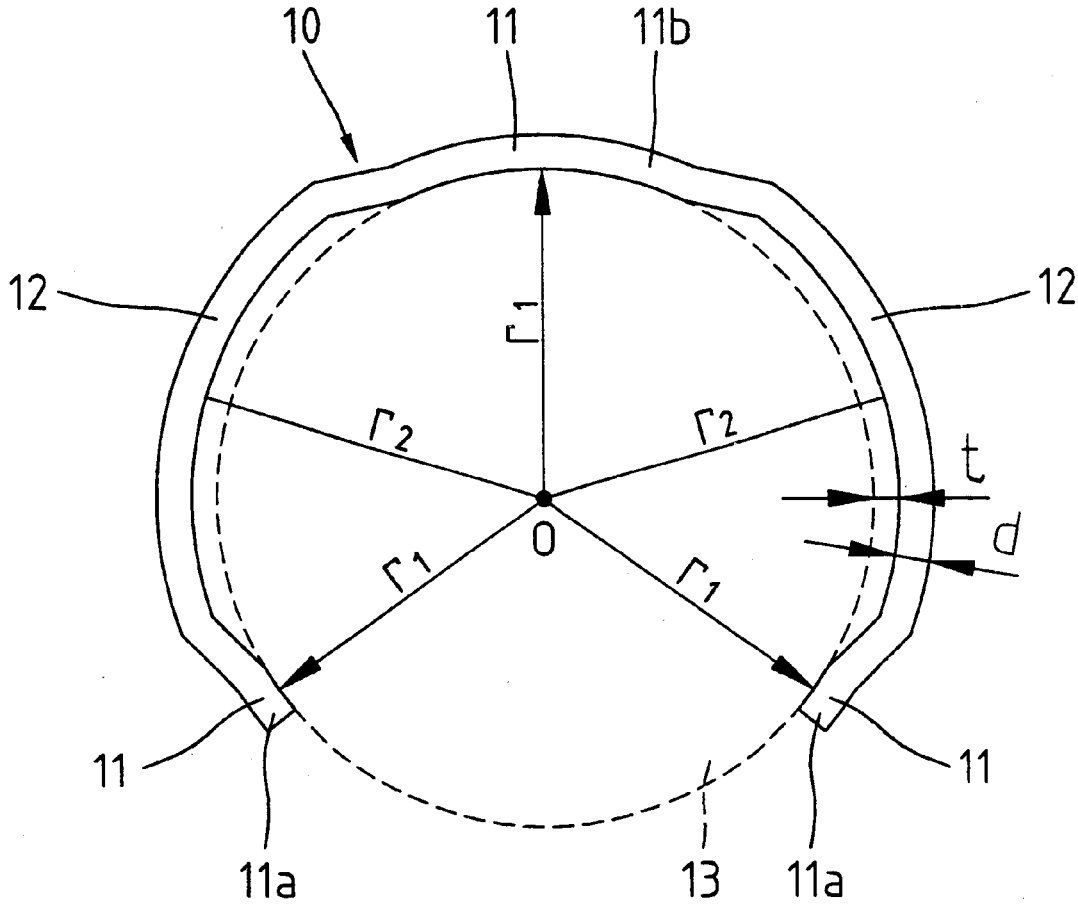
FIG. 1A is a plan view of the retainer ring in accordance with the present invention.
Figure 2:
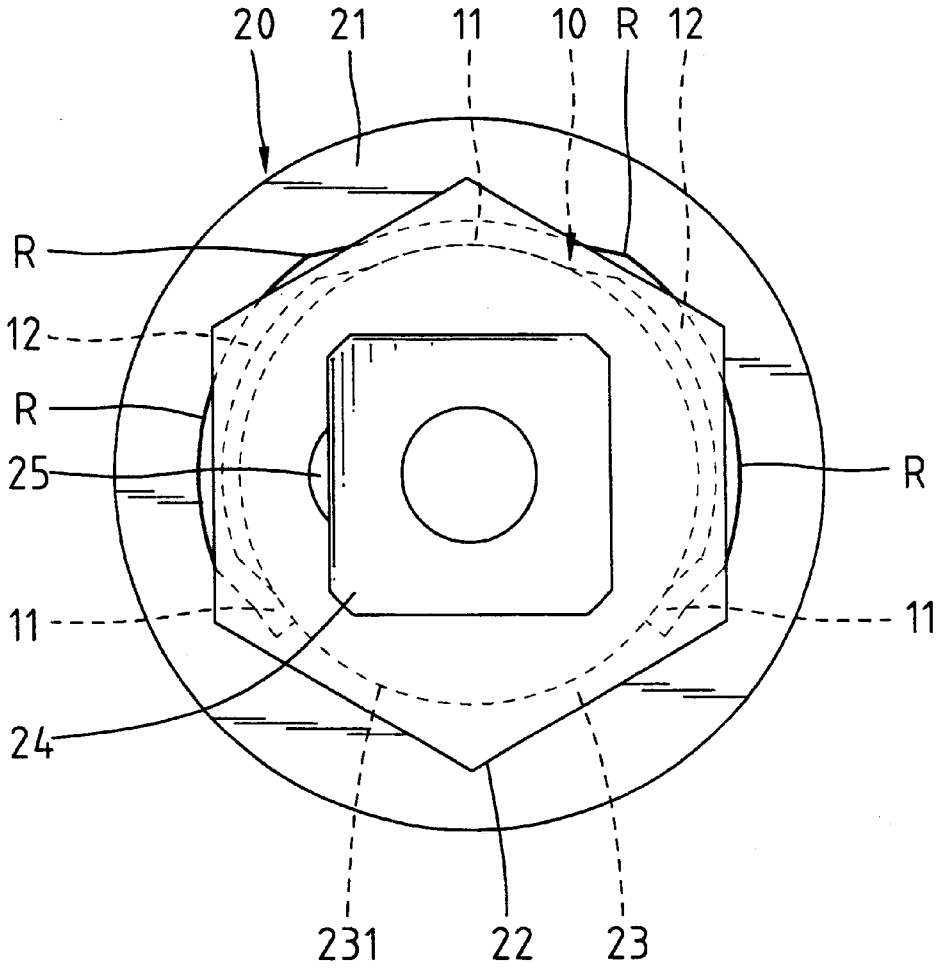
FIG. 2 is a bottom view of the adaptor and the retainer ring in an assembled state.

Referring to FIG. 1A, the retainer ring 10 is resilient and includes at least two radially inward holding sections 11 and at least one radially outward engaging section 12. Namely, the engaging section 12 is located in a position radially outward of the holding sections 11. In this embodiment, the retainer ring 10 includes three holding sections 11 located on two distal ends 11*a* of the retainer ring 10 and a section 11*b* of the retainer ring 10 opposite to an opening 13 of the retainer ring 10 between the distal ends 11*a*. As illustrated in FIG. 1A, each holding section 11 has a radius of curvature $r_1$ equal to half of a diameter of the annular groove 23 defined in the reduced section of the engaging portion 22. Further, the retainer ring 10 includes two engaging sections 12 on both sides of the section 11*b* opposite to the opening 13 of the retainer ring 10. Each engaging section 12 has a radius of curvature $r_2$ greater than the radius of curvature $r_1$ of the holding sections 11. Preferably, the retainer ring 10 has a uniform thickness d. Preferably, the radius of curvature $r_2$ of the engaging sections 12 is greater than the radius of curvature $r_1$ of the holding sections 11 by an amount t less than a thickness d of the retainer ring 10.

Thus, when the retainer ring 10 is mounted in the annular groove 23 of the adaptor 20, the holding sections 11 of the retainer ring 10 securely clamp a bottom wall 231 defining the annular groove 23. Thus, the retainer ring 10 is securely engaged in the annular groove 23 of the adaptor 20 without the risk of relative movement therebetween. This is owing to the fact that each holding section 11 has a radius of curvature $r_1$ equal to half of a diameter of the reduced section of the engaging portion 22. Each engaging section 12 of the retainer ring 10 protrudes beyond the annular groove 23 of the adaptor 20 (see the solid black lines R and the dashed lines between the solid black lines R).

Figure 3:
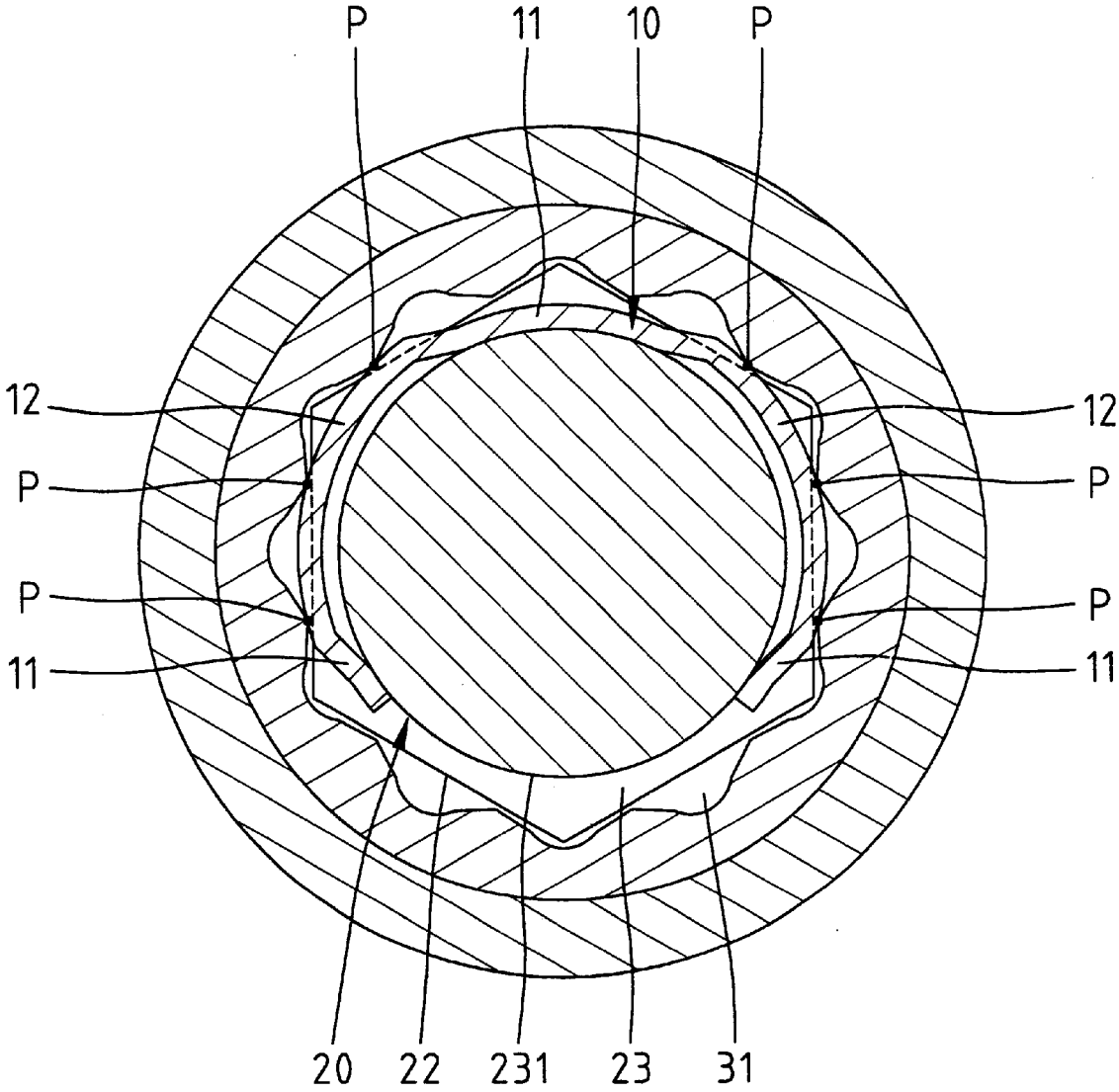
FIG. 3 is a sectional view of an end of the wrench, the adaptor, and the retainer ring in FIG. 2.

Referring to FIG. 3, when the adaptor 20 coupled with the retainer ring 10 is mounted in a dodecagonal receiving compartment 31 of a wrench 30, the retainer ring 10, when compressed, would not move or wobble in the annular groove 23 of the adaptor 20, as the three holding sections 11 of the retainer ring 10 securely clamp the bottom wall 231 defining the annular groove 23 of the adaptor 20. Further, the engaging sections 12 engage with the dodecagonal inner periphery of the receiving compartment 31 at six points P. Thus, the adaptor 20 is securely engaged in the receiving compartment 31 of the wrench 30.

Figure 4:
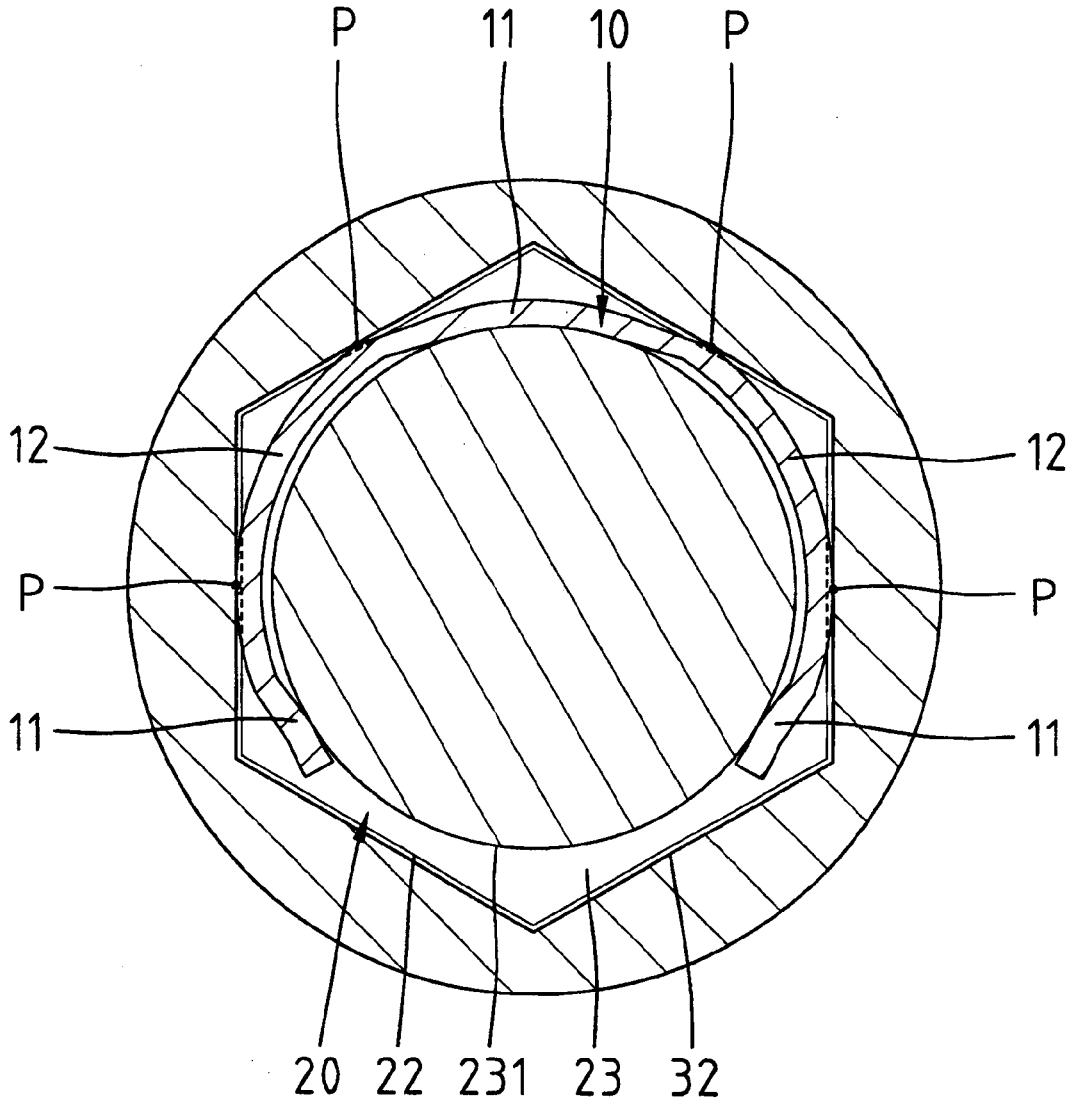
FIG. 4 is a sectional view similar to FIG. 3, illustrating use of the retainer ring with an end of a wrench having a hexagonal inner periphery.

When the adaptor 20 coupled with the retainer ring 10 is mounted in a polygonal receiving compartment 31 of a wrench 30, as illustrated in FIG. 4, the retainer ring 10, when compressed, would not move or wobble in the annular groove 23 of the adaptor 20, as the three holding sections 11 of the retainer ring 10 securely clamp the bottom wall 231 defining the annular groove 23 of the adaptor 20. Further, the engaging sections 12 engage with the hexagonal inner periphery of the receiving compartment 31 at four points P. Thus, the adaptor 20 is securely engaged in the receiving compartment 31 of the wrench 30.

Figure 5:
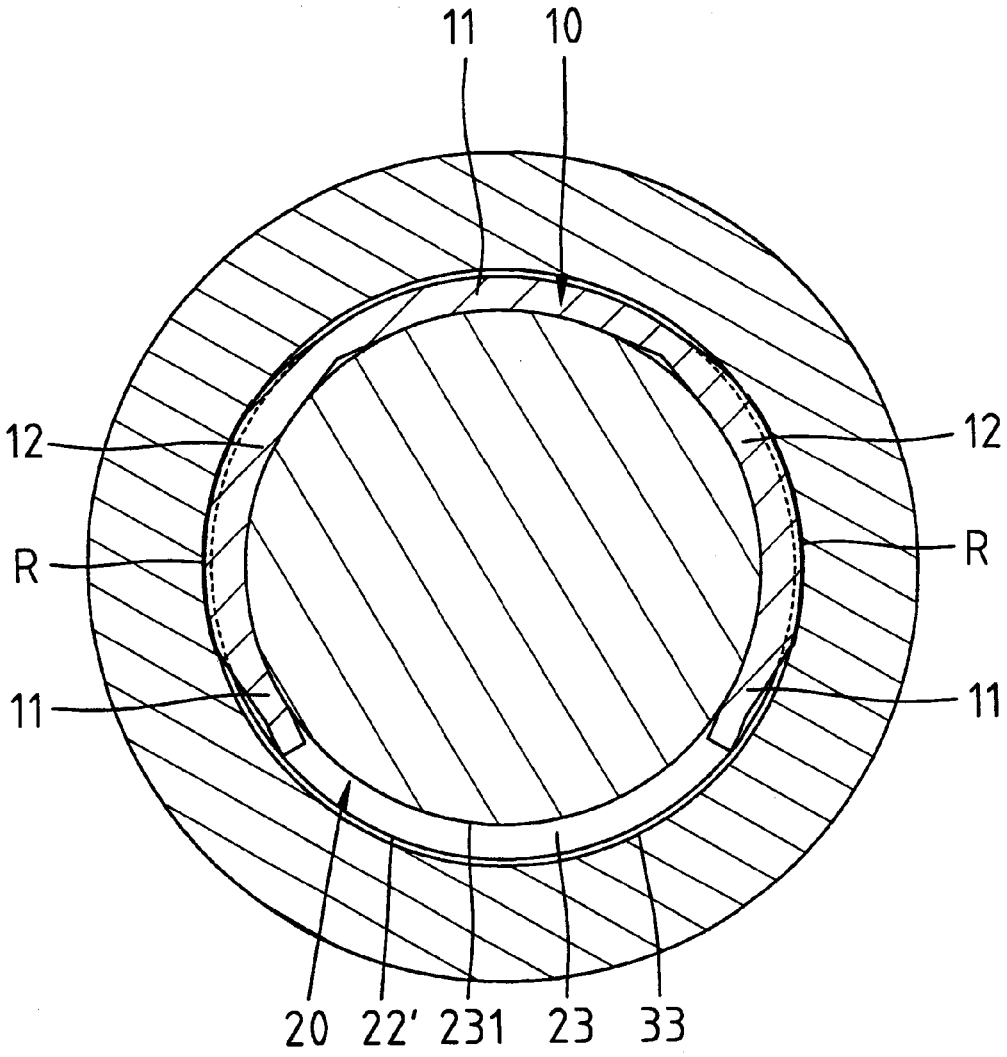
FIG. 5 is a sectional view similar to FIG. 3, illustrating a modified embodiment of the retainer ring in accordance with the present invention.

FIG. 5 illustrates a modified embodiment of the retainer ring 10, wherein like numerals denotes like elements. In this embodiment, the engaging portion (now designated by 22') of the adaptor 20 is circular, and wrench 30 has a circular receiving compartment 33. When mounting the adaptor 20 coupled with the retainer ring 10 is mounted in the circular receiving compartment 33 of the wrench 30, as illustrated in FIG. 5, the retainer ring 10, when compressed, would not move or wobble in the annular groove 23 of the adaptor 20, as the three holding sections 11 of the retainer ring 10 securely clamp the bottom wall 231 defining the annular groove 23 of the adaptor 20. Further, the whole engaging sections 12 engage with the circular inner periphery of the receiving compartment 33 (see the solid black lines R in FIG. 5). Thus, the adaptor 20 is securely engaged in the receiving compartment 33 of the wrench 30.

Figure 6:
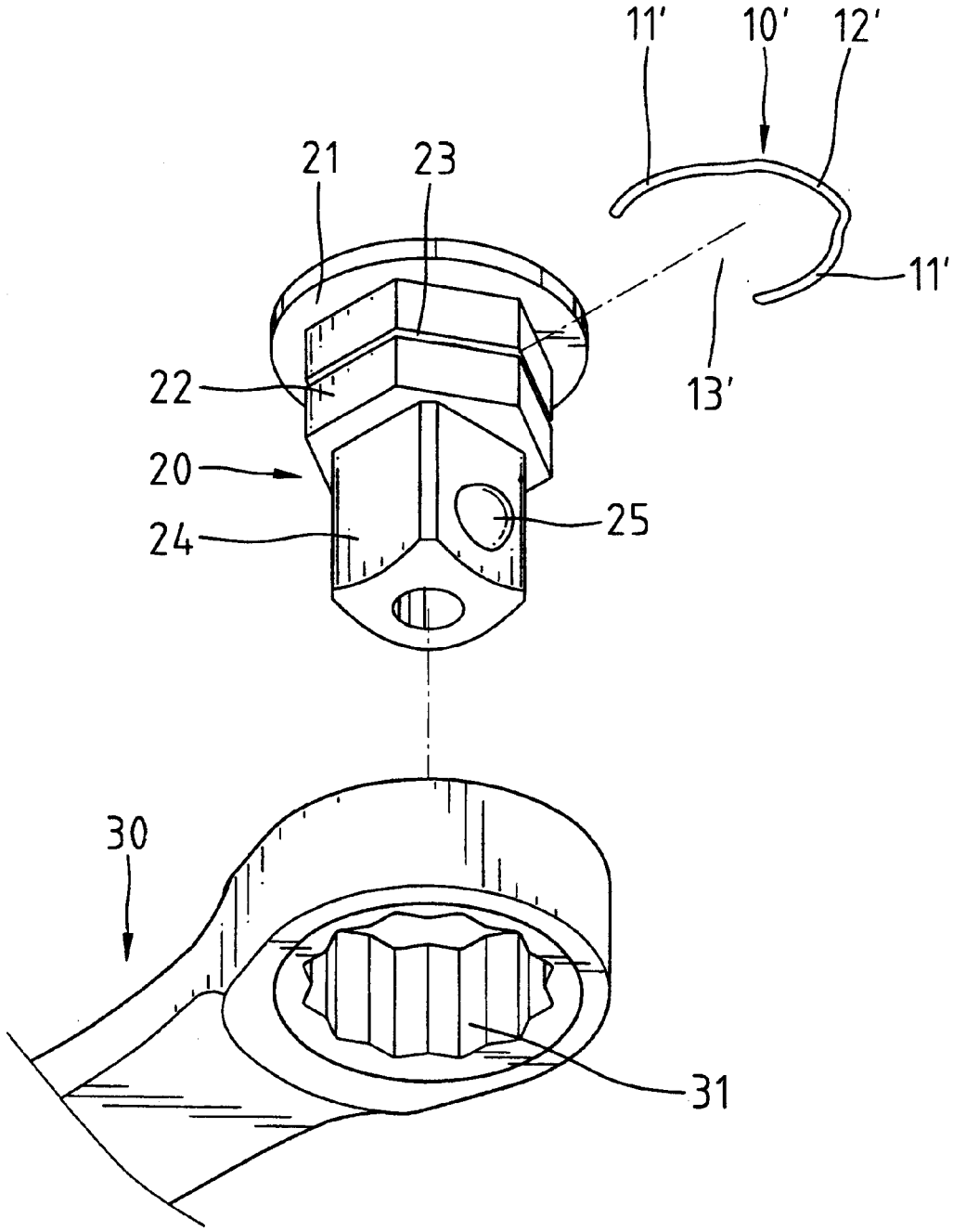
FIG. 6 is an exploded perspective view illustrating a wrench, an adaptor, and another embodiment of the retainer ring in accordance with the present invention.

FIG. 6 illustrates another modified embodiment of the present invention, wherein like numerals denotes like elements. In this embodiment, the retainer ring 10' includes a radially outward engaging section 12' opposite to an opening 13' of the retainer ring 10' and two radially inward holding sections 11'. Each radially inward holding section 11' includes an associated one of the distal ends (not labeled) of the retainer ring 10'. The radii of the holding section 11' and the engaging section 12' in this embodiment are respectively the same as that of the holding section 11 and the engaging section 12 of the embodiment shown in FIG. 1A.

Figure 7:
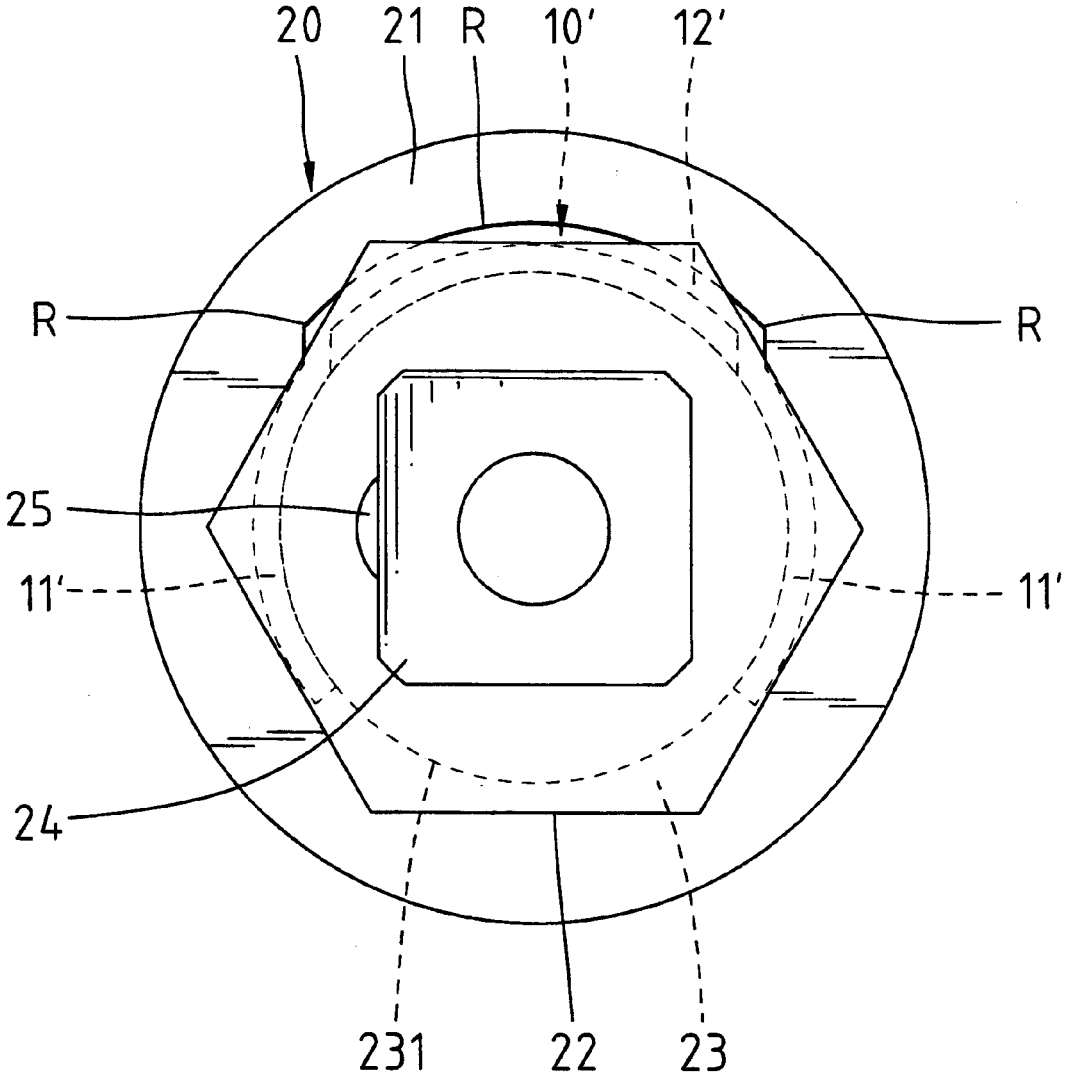
FIG. 7 is a bottom view of the adaptor and the retainer ring of FIG. 6 in an assembled state.

As illustrated in FIG. 7, when mounting the retainer ring 10' to the adaptor 20, the holding sections 11' of the retainer ring 10' securely clamp the bottom wall 231 defining the annular groove 23 of the adaptor 20 without the risk of relative movement therebetween. Further, the engaging section 12' of the retainer ring 10' protrudes beyond the annular groove 23 of the adaptor 20.

Figure 8:
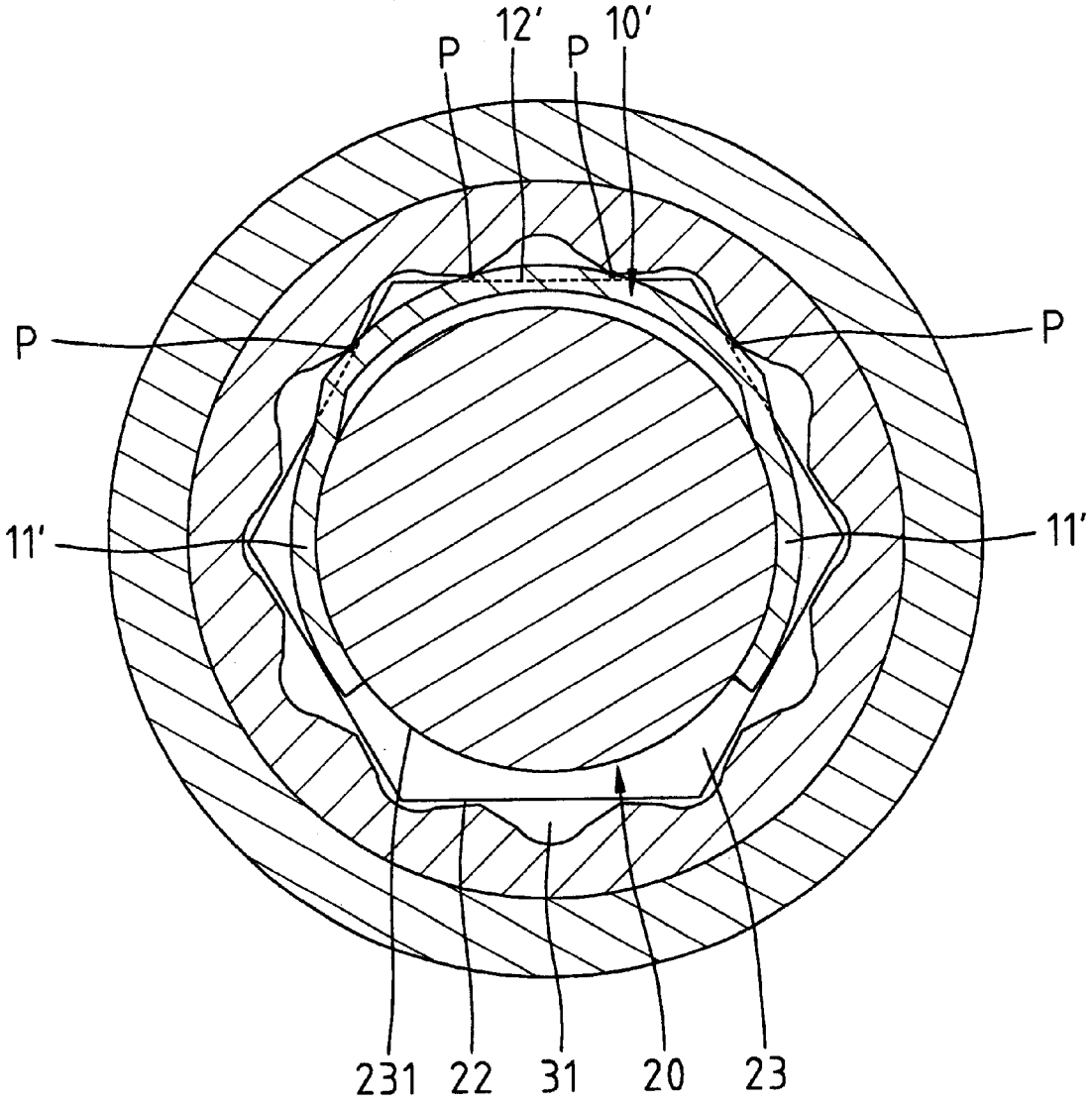
FIG. 8 is a sectional view of the end of the wrench, the adaptor, and the retainer ring in FIG. 7.

When mounting the adaptor 20 coupled with the retainer ring 10' is mounted in a dodecagonal receiving compartment 31 of a wrench 30, as illustrated in FIG. 8, the retainer ring 10', when compressed, would not move or wobble in the annular groove 23 of the adaptor 20, as the holding sections 11' of the retainer ring 10 securely clamp the bottom wall 231 defining the annular groove 23 of the adaptor 20. Further, the engaging section 12' engages with the dodecagonal inner periphery of the receiving compartment 31 at four points P. Thus, the adaptor 20 is securely engaged in the receiving compartment 31 of the wrench 30.

Figure 9:
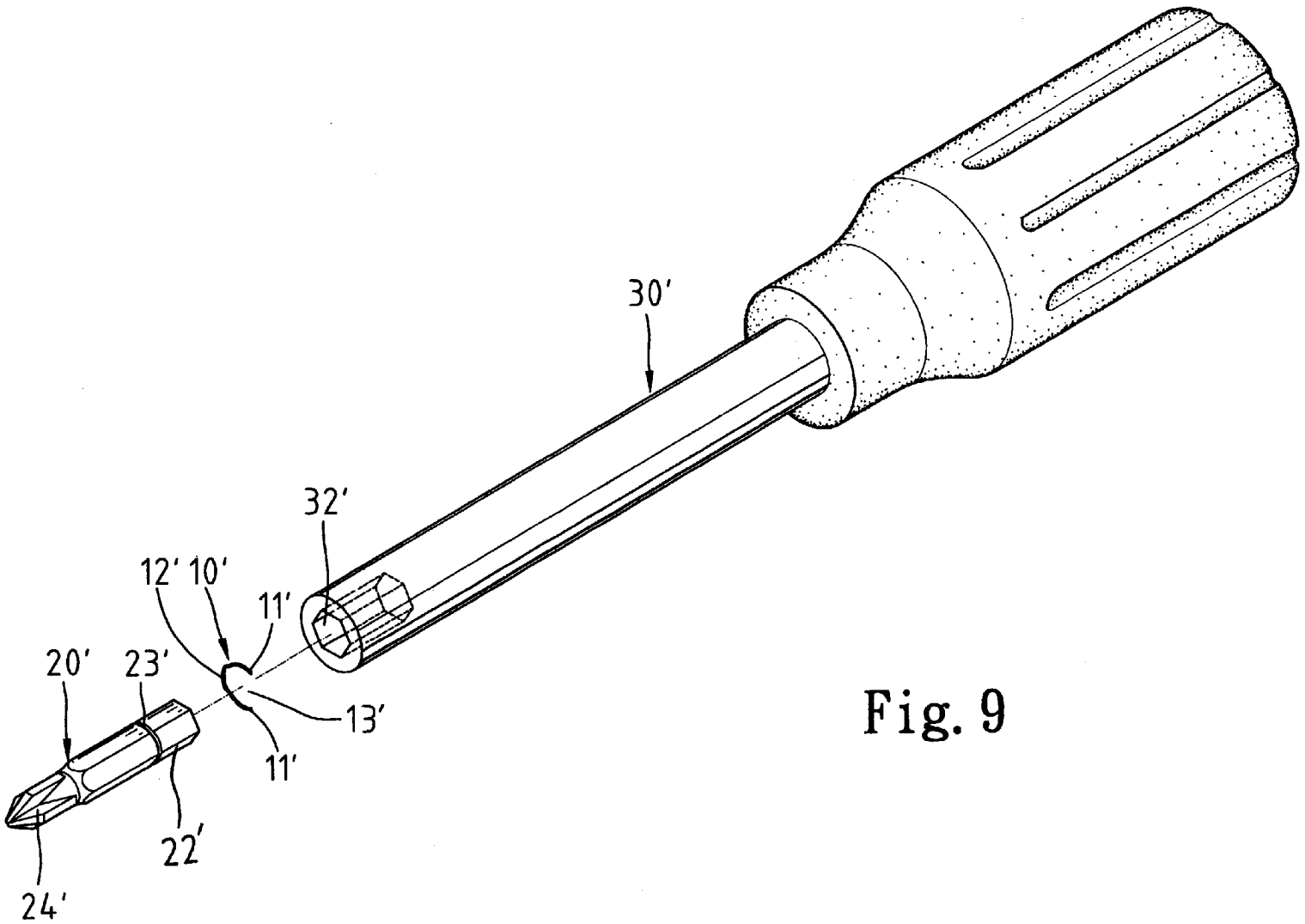
FIG. 9 is an exploded perspective view illustrating a bit, a screwdriver, and another modified embodiment of the retainer ring in accordance with the present invention.

FIG. 9 illustrates a further modified embodiment of the present invention. In this embodiment, the retainer ring 10' includes a radially outward engaging section 12' opposite to an opening 13' of the retainer ring 10' and two radially inward holding sections 11'. Each radially inward holding section 11' includes an associated one of the distal ends (not labeled) of the retainer ring 10'. The retainer ring 10' securely retains a bit 20' to a shank 30' of a screwdriver. An end 22' of the bit 20' is hexagonal and includes a reduced section having an annular groove 23' defined by a bottom wall 231'. A drive end 24' is formed on the other end of the bit 20'. The shank 30' of the screwdriver includes a receiving compartment 32'. The radii of the holding section 11' and the engaging section 12' in this embodiment are respectively the same as that of the holding section 11 and the engaging section 12 of the embodiment shown in FIG. 1A.

Figure 10:
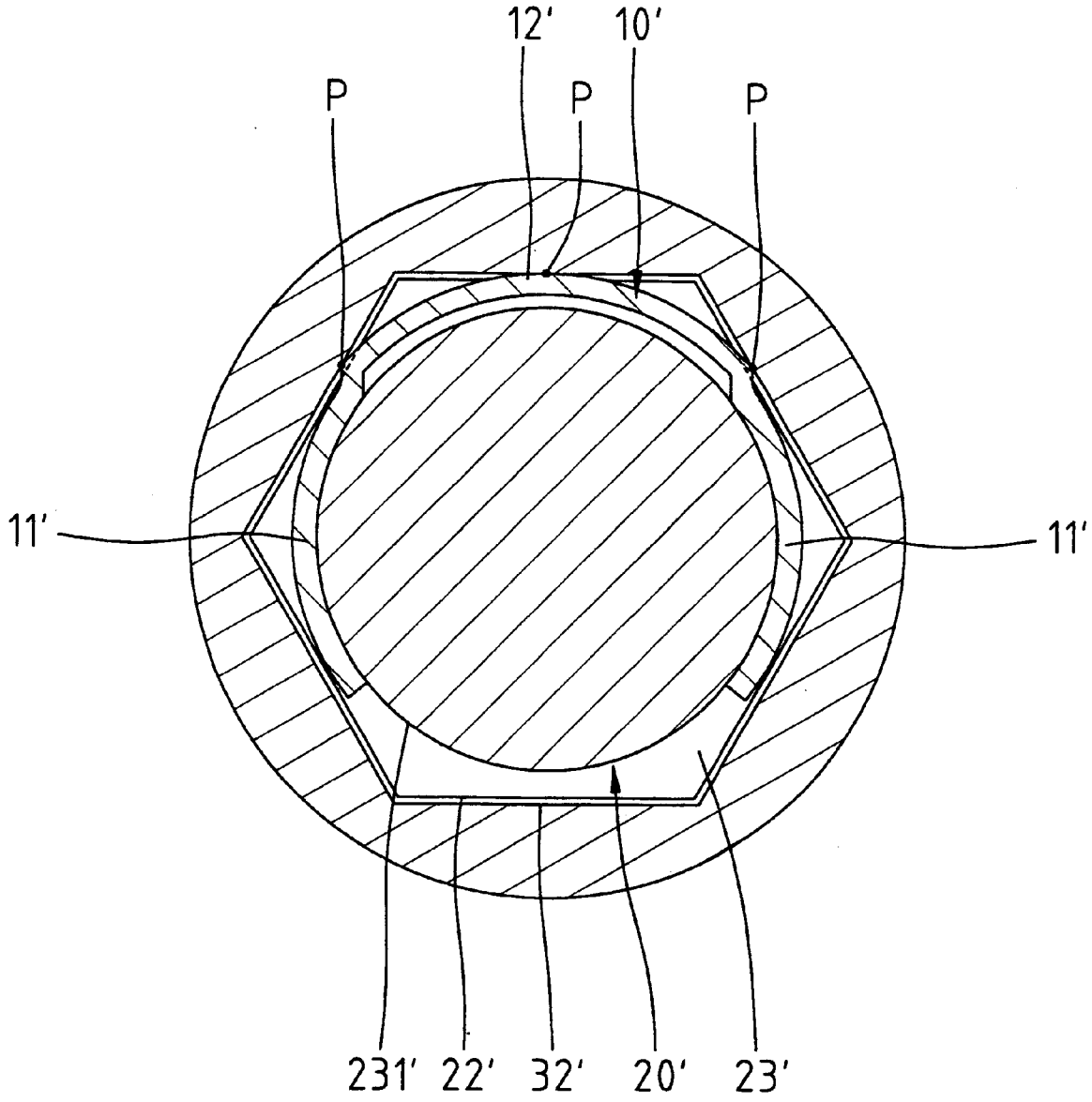
FIG. 10 is a sectional view illustrating engagement between the bit, the screwdriver, and the retainer ring in FIG. 9.

As illustrated in FIG. 10, when mounting the retainer ring 10' to the bit 20', the holding sections 11' of the retainer ring 10' securely clamp the bottom wall 231' defining the annular groove 23' of the bit 20' without the risk of relative movement therebetween. Further, the engaging section 12' of the retainer ring 10' protrudes beyond the annular groove 23' of the bit 20'.

When the bit 20' coupled with the retainer ring 10' is mounted in the hexagonal receiving compartment 32' of the shank 30', as illustrated in FIG. 10, the retainer ring 10', when compressed, would not move or wobble in the annular groove 23' of the bit 20', as the holding sections 11' of the retainer ring 10' securely clamp the bottom wall 231' defining the annular groove 23' of the bit 20'. Further, the engaging section 12' engages with the hexagonal inner periphery of the receiving compartment 32' at three points P. Thus, the bit 20' is securely engaged in the receiving compartment 32' of the shank 30'.

Figure 11:
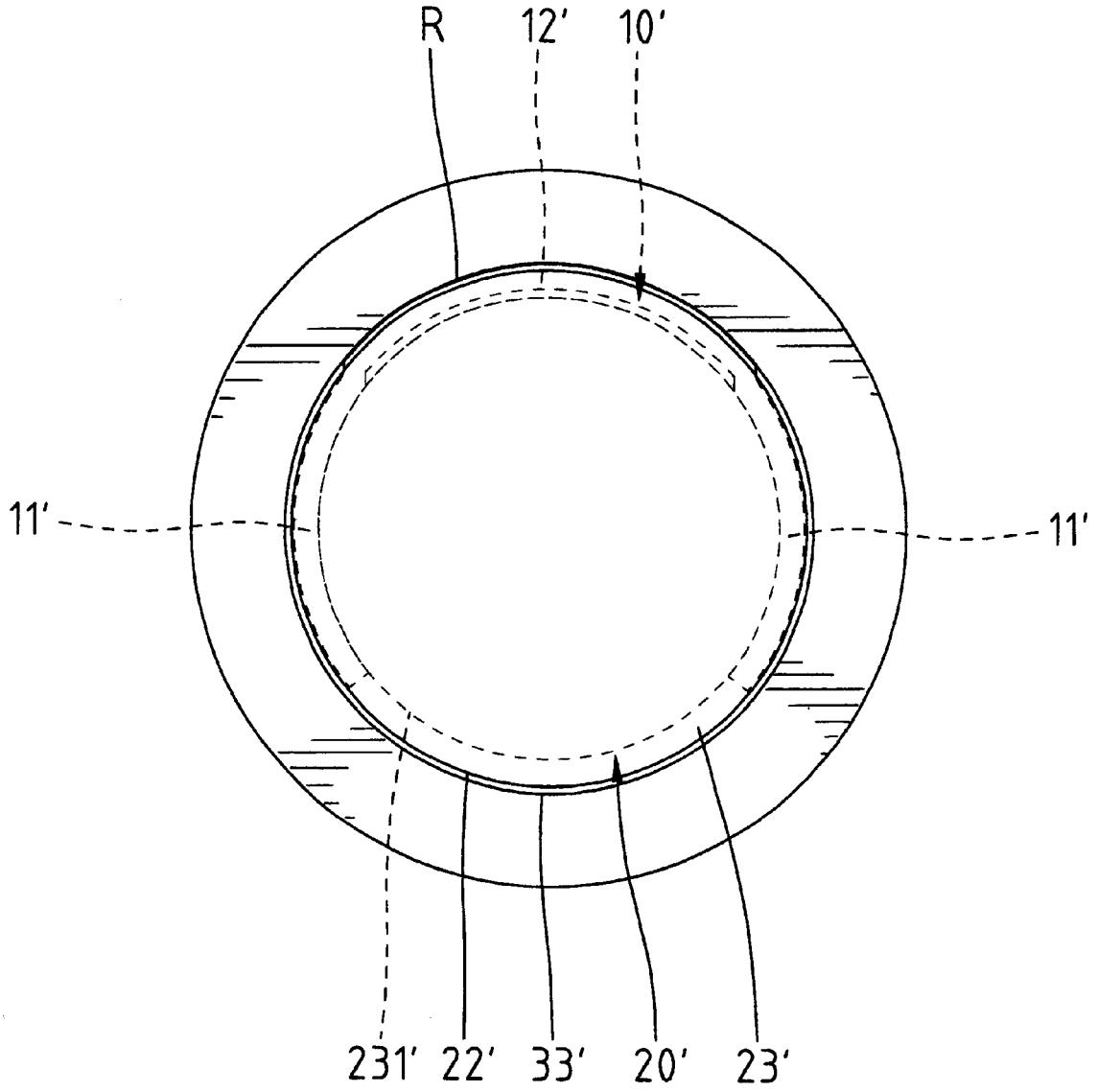
FIG. 11 is a view illustrating use of the retainer ring in a shank having a circular receiving compartment.
Figure 12A:
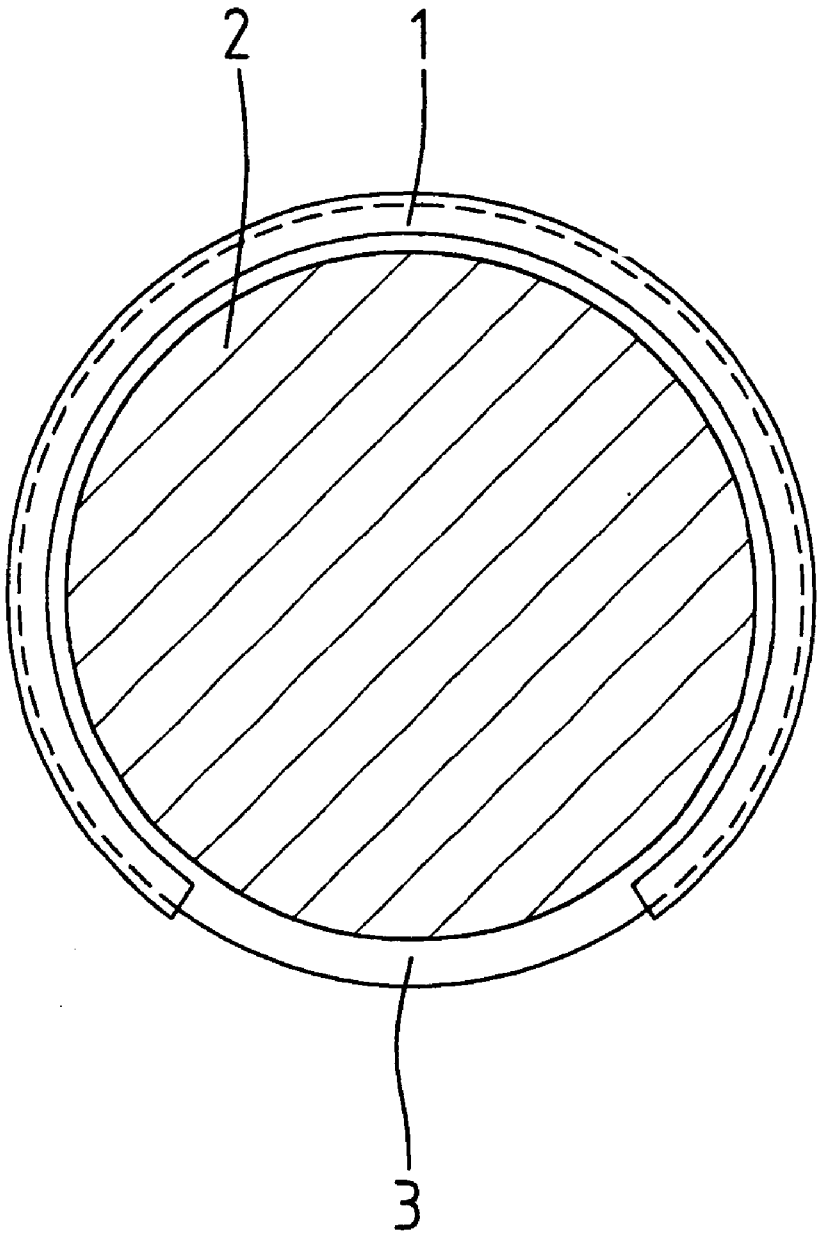
Fig. 12A PRIOR ART
FIG. 12A is a sectional view illustrating engagement between a conventional retainer ring and an adaptor.
Figure 12B:
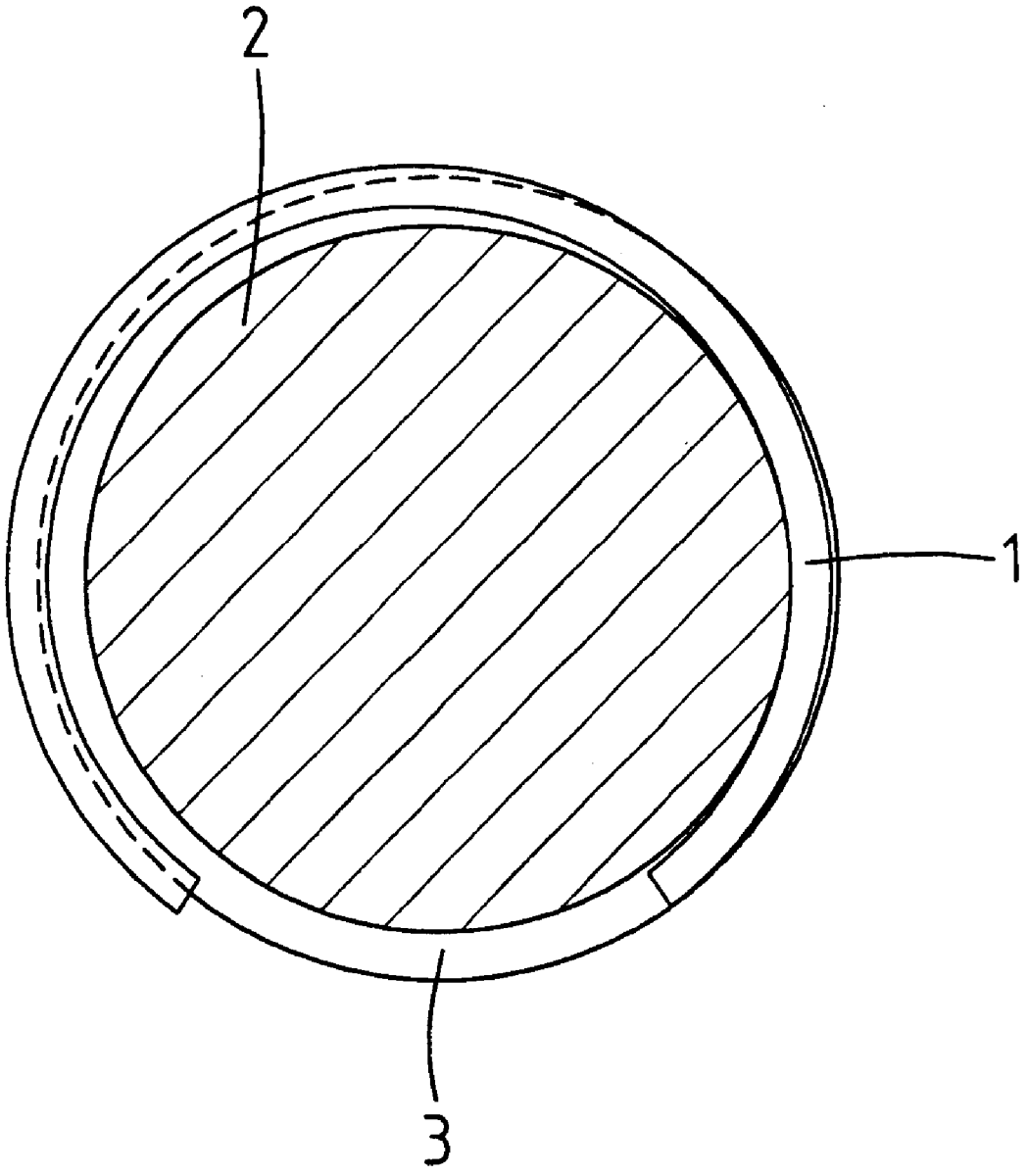
Fig. 12B PRIOR ART
FIG. 12B is a sectional view illustrating anomalous engagement between the retainer ring and the adaptor in FIG. 12A.
Figure 13:
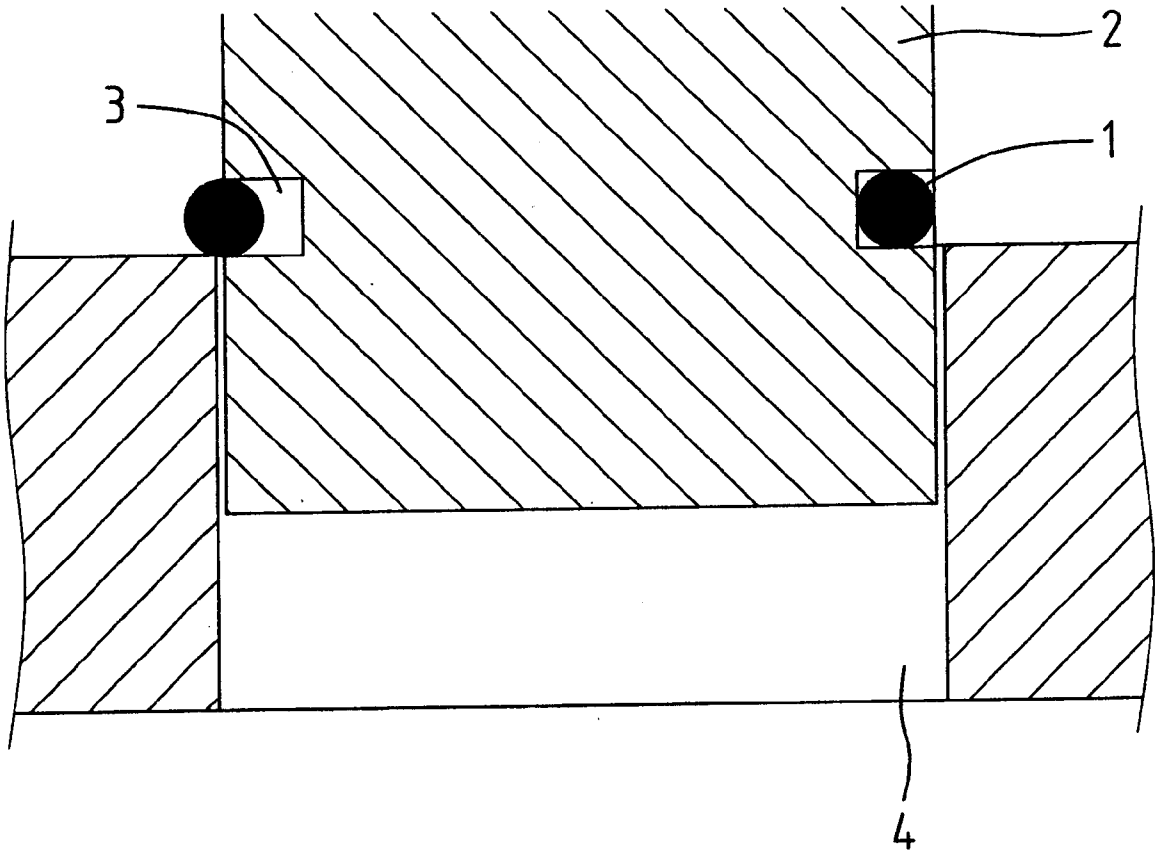
Fig. 13 PRIOR ART
FIG. 13 is a schematic sectional view illustrating difficulty of attaching the adaptor with retainer ring mounted thereon to a wrench.

FIG. 11 illustrates still another modified embodiment that is modified from the embodiment of FIGS. 9 and 10. In this embodiment, the end 22' of the bit 20' is circular and the receiving compartment (now designated by 33') of the shank 30' is also circular. When the bit 20' coupled with the retainer ring 10' is mounted in the circular receiving compartment 33' of the shank 30', as illustrated in FIG. 10, the retainer ring 10' would not move or wobble in to annular groove 23' of the bit 20' when compressed, as the holding sections 11' of the retainer ring 10' securely clamp the bottom wall 231' defining the annular groove 23' of the bit 20'. Further, the engaging section 12' engages with the circular inner periphery of the receiving compartment 33' (see the solid black line R). Thus, the bit 20' is securely engaged in the receiving compartment 33' of the shank 30'. The radii of the holding section 11' and the engaging section 12' in this embodiment are respectively the same as that of the holding section 11 and the engaging section 12 of the embodiment shown in FIG. 1A.

It is noted that the numbers and the shapes of the holding sections 11, 11' and the engaging sections 12, 12' may vary according to the need.

Although the invention has been explained in relation to its preferred embodiment, it is to be understood that many other possible modifications and variations can be made without departing from the scope of the invention as hereinafter claimed.

What is claimed is:

1. A retainer ring for securely retaining a first object having a reduced section to a second object, the retainer ring being resilient and comprising:

at least two holding sections and at least one engaging section, each of said at least two holding sections having an inner radius of curvature equal to half of a diameter of the reduced section of the first object, said at least one engaging section having an inner radius of curvature greater than that of said at least two holding sections;

said at least two holding sections being adapted to securely clamp said reduced section of said first object with said at least one engaging section partially protruding out of said reduced section of said first object for engaging with said second object.

2. The retainer ring as claimed in claim 1, wherein said retainer ring includes two distal ends spaced by an opening, each of said distal ends of said retainer forming an associated one of said at least two holding sections.

3. The retainer ring as claimed in claim 2, wherein a third holding section of said at least two holding sections of said retainer ring is located in a position opposite to said opening.

4. The retainer ring as claimed in claim 1, wherein said retainer ring includes an opening and wherein said at least one engaging section of said retainer ring is opposite to said opening.

5. The retainer ring as claimed in claim 1, wherein said inner radius of curvature of said at least one engaging section is greater than said inner radius of curvature of said at least two holding sections by an amount less than thickness of said retainer ring.

6. The retainer ring as claimed in claim 2, wherein said inner radius of curvature of said at least one engaging section is greater than said inner radius of curvature of said at least two holding sections by an amount less than a thickness of said retainer ring.

7. The retainer ring as claimed in claim 3, wherein said inner radius of curvature of said at least one engaging section is greater than said inner radius of curvature of said at least two holding sections by an amount less than a a thickness of said retainer ring.

8. The retainer ring as claimed in claim 4, wherein said inner radius of curvature of said at least one engaging section is greater than said inner radius of curvature of said at least two holding sections by an amount less than a a thickness of said retainer ring.

9. A combination comprising:

a first object including a reduced section;

a second object including a receiving compartment; and a resilient retainer ring including at least two holding sections and at least one engaging section, each of said at least two holding sections having an inner radius of curvature equal to half of a diameter of said reduced section of said first object, said at least one engaging section having an inner radius of curvature greater than that of said at least two holding sections, said at least two holding sections securely clamping said reduced section of said first object with said at least one engaging section partially protruding out of said reduced section of said first object for engaging with an inner periphery of said receiving compartment of said second object, with engagement of the at least one engaging section with the second object providing for clamping of the at least two holding sections about the reduced section.

10. The combination as claimed in claim 9, wherein said retainer ring includes two distal ends spaced by an opening, each of said distal ends of said retainer forming an associated one of said at least two holding sections.

11. The combination as claimed in claim 10, wherein a third holding section of said at least two holding sections is opposite to said opening.

12. The combination as claimed in claim 9, wherein said retainer ring includes an opening and wherein said at least one engaging section of said retainer ring is opposite to said opening.

13. The combination as claimed in claim 9, wherein the first object is an adaptor and the second object is a box end of a wrench.

14. The combination as claimed in claim 9, wherein the first object is a bit and the second object is a shank of a screwdriver.

15. The combination as claimed in claim 9, wherein said inner radius of curvature of said at least one engaging section is greater than said inner radius of curvature of said at least two holding sections by an amount less than a a thickness of said retainer ring.

16. The combination as claimed in claim 10, wherein said inner radius of curvature of said at least one engaging section is greater than said inner radius of curvature of said at least two holding sections by an amount less than a thickness of said retainer ring.

17. The combination as claimed in claim 11, wherein said inner radius of curvature of said at least one engaging section is greater than said inner radius of curvature of said at least two holding sections by an amount less than a thickness of said retainer ring.

18. The combination as claimed in claim 12, wherein said inner radius of curvature of said at least one engaging section is greater than said inner radius of curvature of said at least two holding sections by an amount less than a thickness of said retainer ring.

19. The combination as claimed in claim 13, wherein said inner radius of curvature of said at least one engaging section is greater than said inner radius of curvature of said at least two holding sections by an amount less than a thickness of said retainer ring.

20. The combination as claimed in claim 14, wherein said inner radius of curvature of said at least one engaging section is greater than said inner radius of curvature of said at least two holding sections by an amount less than a thickness of said retainer ring.

* * * * *